US007594335B1

(12) United States Patent
Schmitz

(10) Patent No.: US 7,594,335 B1
(45) Date of Patent: Sep. 29, 2009

(54) BOW SIGHTING DEVICE

(76) Inventor: Mitchell Schmitz, 107 Dianne Dr., Brookhaven, MS (US) 39601

( * ) Notice: Subject to any disclaimer, the term of this patent is extended or adjusted under 35 U.S.C. 154(b) by 0 days.

(21) Appl. No.: 11/939,466

(22) Filed: Nov. 13, 2007

(51) Int. Cl.
*F41G 1/467* (2006.01)

(52) U.S. Cl. ..... 33/265

(58) Field of Classification Search ..... 33/265; 124/87
See application file for complete search history.

(56) References Cited

U.S. PATENT DOCUMENTS

| | | | | | |
|---|---|---|---|---|---|
| 3,696,517 | A | | 10/1972 | Larson | |
| 3,875,674 | A | * | 4/1975 | Davidson | 33/265 |
| 4,159,575 | A | | 7/1979 | Kalmbach | |
| 4,494,313 | A | | 1/1985 | Scott | |
| 4,757,614 | A | | 7/1988 | Kudlacek | |
| 4,813,150 | A | | 3/1989 | Colvin | |
| 4,915,088 | A | * | 4/1990 | Powers | 124/87 |
| 4,977,678 | A | | 12/1990 | Sears | |
| 5,048,193 | A | | 9/1991 | Hacquet | |
| 5,379,747 | A | * | 1/1995 | Morris et al. | 124/87 |
| 5,718,215 | A | * | 2/1998 | Kenny et al. | 124/87 |
| 6,397,483 | B1 | * | 6/2002 | Perkins | 33/265 |
| 6,519,859 | B2 | * | 2/2003 | Beshires | 33/265 |
| 6,560,884 | B1 | * | 5/2003 | Afshari | 33/265 |
| 6,732,727 | B1 | | 5/2004 | Gallops, Jr. | |
| 7,124,512 | B2 | | 10/2006 | Forrest | |
| 7,266,896 | B1 | * | 9/2007 | White | 33/265 |
| 7,461,460 | B2 | * | 12/2008 | Priebe | 33/265 |
| 2004/0088872 | A1 | * | 5/2004 | Deien | 33/265 |

FOREIGN PATENT DOCUMENTS

| | | |
|---|---|---|
| CA | 2.141.644 | 11/1999 |
| GB | 1249444 | 10/1971 |

* cited by examiner

*Primary Examiner*—Christopher W Fulton
(74) *Attorney, Agent, or Firm*—Michael I. Kroll

(57) ABSTRACT

A bow sight comprising a bow mounting bracket with front and rear sighting apparatus with an alternate lighting element situated near the rear-sight sight-pin that may incorporate a length of optical fiber for illuminating the same. The front sighting apparatus is comprised of a front-sight sight-pin housing, attachable track, front-sight mounting mateable to the track and mounting bracket with the rear-sight apparatus comprising a rear-sight sight-pin releasably and slidably attached to a platform that is slidably attached to the mounting frame. The sight-pins have a substantially Y-shape with the apex divergent arms extending from a semicircular base recess.

12 Claims, 15 Drawing Sheets

BOW SIGHTING DEVICE

BACKGROUND OF THE INVENTION

1. Field of the Invention

The present invention relates generally to sporting equipment and, more specifically, to a bow sighting device comprising a mounting bracket having a plurality of threaded apertures therethrough for mounting to a bow in a typical manner with front and rear sighting apparatus releasably attached to the mounting bracket whereby targeting adjustments can be made in addition to mounting adjustments for left or right handed users. Alternately provided is a lighting element releasably fixed approximate the rear sight pin that may incorporate a length of optical fiber.

The front-sight apparatus is composed of a sight-pin housing, housing attachable track, track mating front-sight mounting attachable to the mounting bracket, and at least one sight-pin with optical fiber within said housing. The rear-sight apparatus is composed of a mounting bracket attachable platform and a sight-pin.

All of the sight-pins have a somewhat Y-shape with the apex divergent arms extending from a semicircular base, as opposed to the typical sight pins having a V-shaped notch, which by design provides for easily aligning the semicircular pin trough with the desired pin point of optical fiber positioned within the front-sight sight-pin.

More than one optical fiber may be positioned within the front sight sight-pin and may be of different colors. Furthermore, the instant invention provides that the one or more optical fibers may extend from the back side of the front-sight sight-pin and be anchored in such a manner as to be hidden from view when using the sighting device. Alternately provided is an engageable lighting element that will illuminate the optical fibers providing pin points of light emanating from the optical fiber ends terminating in the front side of the sight-pin. The rear sight sight-pin may also have one or more optical fibers having terminal ends on the front side of the pin which can be illuminated from a selectively engageable lighting element.

It is further envisioned that the sight-pin itself may incorporate a selectively engageable lighting element in communication with optical fibers having a terminus on the front side of the sight-pin. Alternately provide for with this configuration is a movable gateway positioned between the bulb and fibers for selectively illuminating one or more of the optical fibers.

2. Description of the Prior Art

There are other sighting devices designed for bows. Typical of these is U.S. Pat. No. 3,696,517 issued to Larson on Oct. 10, 1972.

Another patent was issued to Kalmbach on Jul. 3, 1979 as U.S. Pat. No. 4,159,575. Yet another U.S. Pat. No. 4,494,313 was issued to Scott on Jan. 22, 1985 and still yet another was issued on Jul. 19, 1988 to Kudlacek as U.S. Pat. No. 4,757,614.

Another patent was issued to Colvin on Mar. 21, 1989 as U.S. Pat. No. 4,813,150. Yet another U.S. Pat. No. 4,977,678 was issued to Sears on Dec. 18, 1990. Another was issued to Hacquet on Sep. 17, 1991 as U.S. Pat. No. 5,048,193 and still yet another was issued on May 11, 2004 to Gallops, Jr. as U.S. Pat. No. 6,732,727.

Another patent was issued to Forrest on Oct. 24, 2006 as U.S. Pat. No. 7,124,512. Yet another U.K. Patent No. GB 1,249,444 was issued to Tinnefeld on Oct. 13, 1971. Another was issued to Stewart on Nov. 9, 1999.

U.S. Pat. No. 3,696,517

Inventor: Marlow W. Larson

Issued: Oct. 10, 1972

A range finder and bow sight device wherein plural sights are made adjustable and correlated with a fixed, stepped range finder. The individual bow sights used are adjustable both for height and azimuth, and in a preferred form of the invention, can be locked through such adjustment to a vertical slide member. Mounts on the device are self-aligning and can be screwed or taped to a conventional archery bow.

U.S. Pat. No. 4,159,575

Inventor: Phillip Kalmbach

Issued: Jul. 3, 1979

The device includes an elongated body in the form of a metal strip that is secured to one side of an archery bow. At the rear end of the body there is a laterally extending arm on which is mounted a rotatable disc having a number of sight openings therein, the sight openings being at differing distances from the disc's axis of rotation. Detent means assures that whatever sight opening is selected remains in position, yet readily permits another sight opening to be selected for a different shooting range. At the front end of the elongated body is another laterally extending arm, this arm having a plurality of vertically oriented threaded apertures into any one of which can be threaded a pin provided with a bead or ball on its upper end. By properly selecting the particular sighting opening at the rear and by properly adjusting the height of the bead or ball at the front, the bowman is able to control quite accurately the course of the arrow.

U.S. Pat. No. 4,494,313

Inventor: Doyce E. Scott

Issued: Jan. 22, 1985

An archery sighting device which includes an elongated sight bracket fixedly attached to the bow above the hand grip portion. A horizontally disposed tab at the rear of the sight bracket has a "V" notch coplanar with the plane formed by the extended bow string and defines a central sighting point intermediate the bow and the relaxed position of the bow string. A plurality of pin sights are disposed at the front end of the sight bracket which define the forward sight point. The plurality of pin sights individually designate preselected shooting distances. The bow string in its extended or drawn position is the third sighting point. Sighting is achieved by the coplanar alignment of the extended bow string with the inverted apex of the "V" notch and the sight pin representing the desired shooting distances.

U.S. Pat. No. 4,757,614

Inventor: Donald S. Kudlacek

Issued: Jul. 19, 1988

An archery bow sight includes a plate arranged for removable attachment to the handle portion of an archery bow and supporting a longitudinally extendable mounting arm which mounts at its forward end a horizontally extending support to which a vertically elongated sight bar is mounted for horizontal windage adjustment. The sight bar mounts a plurality of sight pin blocks by means of interconnecting dovetail components, the blocks extending transversely across the sight bar for adjustment along the length of the sight bar. An elongated threaded sight pin member extends adjustably through a threaded bore in each block in the transverse direction of the sight bar, and a slot intercepts the dovetail component and sight pin bore in the block. A clamp screw in the block extends across the slot and operates upon rotation in one direction to clamp the block to the sight bar and the sight pin to the block.

U.S. Pat. No. 4,813,150

Inventor: Richard Colvin

Issued: Mar. 21, 1989

A sighting device for use with an archery bow, comprising a mounting plate mountable on the bow; an elongated support track attached to the mounting plate; at least one blade-like sight element connected generally perpendicular to the support track, the blade-like element being oriented edge-wise relative to the line of sight of the archer, a light emitting diode attached to the blade-like element along the edge thereof facing the archer, the light emitting diode being electrically connectable to an electrical power source; switch means controlling activation of the light emitting diode by the electrical power source; means for manually adjusting the light emitting diode vertically and horizontally, and draw indicator means indicating the position of an arrow used with the bow, the draw indicator means being operative to switch the switch means to activate the light emitting diode when the arrow is at a predetermined position.

U.S. Pat. No. 4,977,678

Inventor: Benny Sears

Issued: Dec. 18, 1990

An archery sight for use with a bow has one or more adjustable beaded sighting pins extending vertically, parallel to the bow frame. A notched sighting plate is mounted remote from the pins with the notches aligned with the pins in the sighting direction.

U.S. Pat. No. 5,048,193

Inventor: Rodney D. Hacquet

Issued: Sep. 17, 1991

An archery bow sight apparatus having a sight bar with at least one front sight that is adjustable to a fixed position relative to the sight bar, and a rear sight that is independently pivotal to maintain a vertical alignment with the ground, which combination of fixed and pivotal sights provide an archer with an improved sight means for greater accuracy in clustering his arrows in a target.

U.S. Pat. No. 6,732,727

Inventor: Henry M. Gallops, Jr.

Issued: May 11, 2004

An archery bow including a bow speed specific sight pin block having sight pin openings for sight pins located therein relative to each other at fixed distances for a given bow speed, so that when a single sight pin is manually positioned to indicate its corresponding arrow flight range, each of the other sight pins in the other openings will be in position to indicate their corresponding arrow flight range. The sight pin block may be mounted in a riser opening and allen screws may be included in the bowsight pin block frame for moving wedges located in the bowsight pin block frame into engagement with a sidewall of the riser opening for mounting the bowsight pin block in the riser opening.

U.S. Pat. No. 7,124,512

Inventor: Richard Forrest

Issued: Oct. 24, 2006

An archery combination involving an archery bow and a bow sight. The bow sight uses a brace secured to the bow with at least two sighting pins which extend at right angles to the archer's line of sighting. A protective guard is secured to the brace and, is moveable between a protective position around the sighting pins to a position which exposes the pins. When the protective guard is in position to expose the sighting pins, the pins are released or "unlocked" from the brace allowing the sighting pins to be easily removed from the brace for repositioning; when the protective guard is in the protective position, the pins are "locked" and cannot be removed from the bow sight.

U.K. Patent Number GB 1249444

Inventor: August Tinnefeld

Issued: Oct. 13, 1971

A sighting device (19) for an archery bow comprises an adjusting scale mounted by means of rods 9 on a block 8 to which is pivotally mounted a sighting bar 12 carrying, at its free end, a laterally adjustable sight pin assembly 22, and where it contacts the scale, a locking screw 29. The sighting device is detachably mounted, mounted by means of locating lugs 15, 16, into sockets 13 and 14 of block 7 which is permanently attached to the back (i.e. side facing the target) of the bow. A pointer 30 attached to the sighting arm is arranged to indicate scale readings.

Canada Patent Number CA 2,141,644

Inventor: Richard J. Stewart

Issued: Nov. 9, 1999

The present invention includes an arrow guide and bow sight adaptable to right-handed or left-handed archery bows. The arrow guide including a vertical support wheel with a V-shaped groove running along its circumference in which an arrow may rest when shooting. This wheel is designed to spin freely on a support rod, reducing friction imparted to the arrow shaft, thus increasing the accuracy, speed, and power of the archer's shot. For lateral support, two horizontal wheels are positioned to either side of the vertical support wheel to prevent the arrow from falling off of the vertical support wheel when the bow is jarred or when the bow string is quickly drawn back. Also connected to the arrow guide device is a sighting device comprising a multiplicity of sight pins and a vertical cross-hair. The sight pins are vertically adjustable to be calibrated to assorted ranges, and both the pins and the cross-hair are horizontally adjustable to account for windage.

While these sighting devices may be suitable for the purposes for which they were designed, they would not be as suitable for the purposes of the present invention, as hereinafter described.

SUMMARY OF THE PRESENT INVENTION

A primary object of the present invention is to provide a bow sighting device that overcomes the shortcomings of the prior art.

Another object of the present invention is to provide a sighting pin having a substantially Y-shape with apex divergent arms extending from a semicircular base forming the crux of the sighting alignment.

Yet another object of the present invention is to provide a bow attachable sighting device comprising a mounting frame incorporating aperture means for attaching to a bow having adjustable front and rear sight apparatus incorporating the aforementioned sight-pin design.

Still yet another object of the present invention is to provide said bow sighting device wherein the mounting frame includes appropriate tracks and channels whereby the front and rear sight apparatuses are adjustably fastenable thereto.

An additional object of the present invention is to provide said bow sighting device with a front-sight apparatus having sight-pin housing with a fixedly attachable track whereby said housing can be positioned for either right of left handed users.

A further object of the present invention is to provide said bow sighting device with a front-sight apparatus having a front-sight mounting with a channel that is slidingly engagable with the releasable housing track, including fastener for binding the channel and track relative to each other in a user derived positioning, preferably the track and channel have a dovetail shape.

A yet further object of the present invention is to provide said bow sighting device front-sight mounting with a track whereby said front-sight mounting and attached sight-pin housing can be releasably attached to the bow mounting bracket.

A still yet further object of the present invention is to provide the bow mounting bracket with a channel for adjustably receiving the front-sight mounting track, and fastener for securing the front-sight assemblage to the mounting bracket in a user derived positioning.

Another object of the present invention is to provide said front-sight housing with a slot for slidably mounting at least one front-sight sight-pin therein and a fastener for securing the positioning of the sight-pin as desired by the user.

Yet another object of the present invention is to provide said front-sight sight-pin housing with apertures for mounting or a slot for slidably mounting a plurality of front-sight sight-pins therein and fasteners for securing the positioning of the sight-pins as desired by the user.

Still yet another object of the present invention is to provide the front-sight sight-pin with at least one optical fiber having a terminal end approximately flush with the sight-pin front surface.

An additional object of the present invention is to provide the front-sight sight-pin with a plurality of optical fibers with each having a terminal end approximately flush with the sight-pin front surface and spaced apart one from the other.

A further object of the present invention is to provide for the at least one front-sight optical fiber to extend from the rear of the front-sight sight-pin providing a path for light waves to be emitted from the optical fiber front terminus end.

A yet further object of the present invention is to provide the front-sight housing with a switch-enabled lighting element for impinging light waves onto the optical fibers of the front-sight sight-pin(s).

A still yet further object of the present invention is to alternately provide at least one front-sight sight-pin incorporating a switch-enabled lighting element forming an integral part therewith in optical communication with at least one optical fiber having a terminal end approximately flush with the pin's front exterior surface.

Another object of the present invention is to provide a bow sighting device having a rear-sight apparatus slidably attachable to the mounting frame and securable in a user derived positioning through provided fasteners.

Yet another object of the present invention is to provide a rear-sight apparatus comprising a slidably attached platform with aperture for attaching a rear-sight sight-pin thereto.

Still yet another object of the present invention is to provide said rear-sight platform with a slot for slidably attaching the rear-sight sight-pin therein and securing the rear-sight sight-pin in a user desired positioning through provided fastener.

An additional object of the present invention is to provide the rear-sight sight-pin with at least one optical fiber having a terminal end approximately flush with the sight-pin front surface.

A further object of the present invention is to provide the rear-sight sight-pin with a plurality of optical fibers with each having a terminal end approximately flush with the sight-pin front surface and spaced apart one from the other.

A yet further object of the present invention is to provide for the at least one rear-sight optical fiber to extend from the back side of the rear-sight sight-pin providing a path for light waves to be emitted from the optical fiber front terminus end.

A still yet further object of the present invention is to provide the mounting frame with a switch-enabled lighting element for impinging light waves onto the optical fibers of the rear-sight sight-pin.

Another object of the present invention is to alternately provide the rear-sight sight-pin incorporating a switch-enabled lighting element forming an integral part therewith in optical communication with at least one optical fiber having a terminal end approximately flush with the rear pin's front exterior surface.

Still yet another object of the present invention is to alternately provide a rear-site sight-pin having the aforementioned Y-shape with divergent arms extending from the semicircular base having a longitudinal slot within the sight-pin body in lieu of the aforementioned optical fiber(s).

Additional objects of the present invention will appear as the description proceeds.

The present invention overcomes the shortcomings of the prior art by providing a bow sight comprising a bow mounting bracket with front and rear sighting apparatus with an alternate lighting element situated near the rear-sight sight-pin that may incorporate a length of optical fiber for illuminating the same. The front sighting apparatus is comprised of a front-sight sight-pin housing, attachable track, front-sight mounting mateable to the track and mounting bracket with the rear-sight apparatus comprising a rear-sight sight-pin releasably and slidably attached to a platform that is slidably attached to the mounting frame. The sight-pins have a substantially Y-shape with the apex divergent arms extending from a semicircular base. Optical fibers are provided and positioned with a terminal end approximately flush with the front exterior pin surface with strategically placed switch-enabled lighting elements for impinging light waves onto the optical fibers which may be of different colors. Alternately provided for is a rear-sight sight-pin having a longitudinal slot in place of the optical fibers and furthermore providing sight-pins incorporating the switchable lighting element as an integral part in optical communication with the optical fibers.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
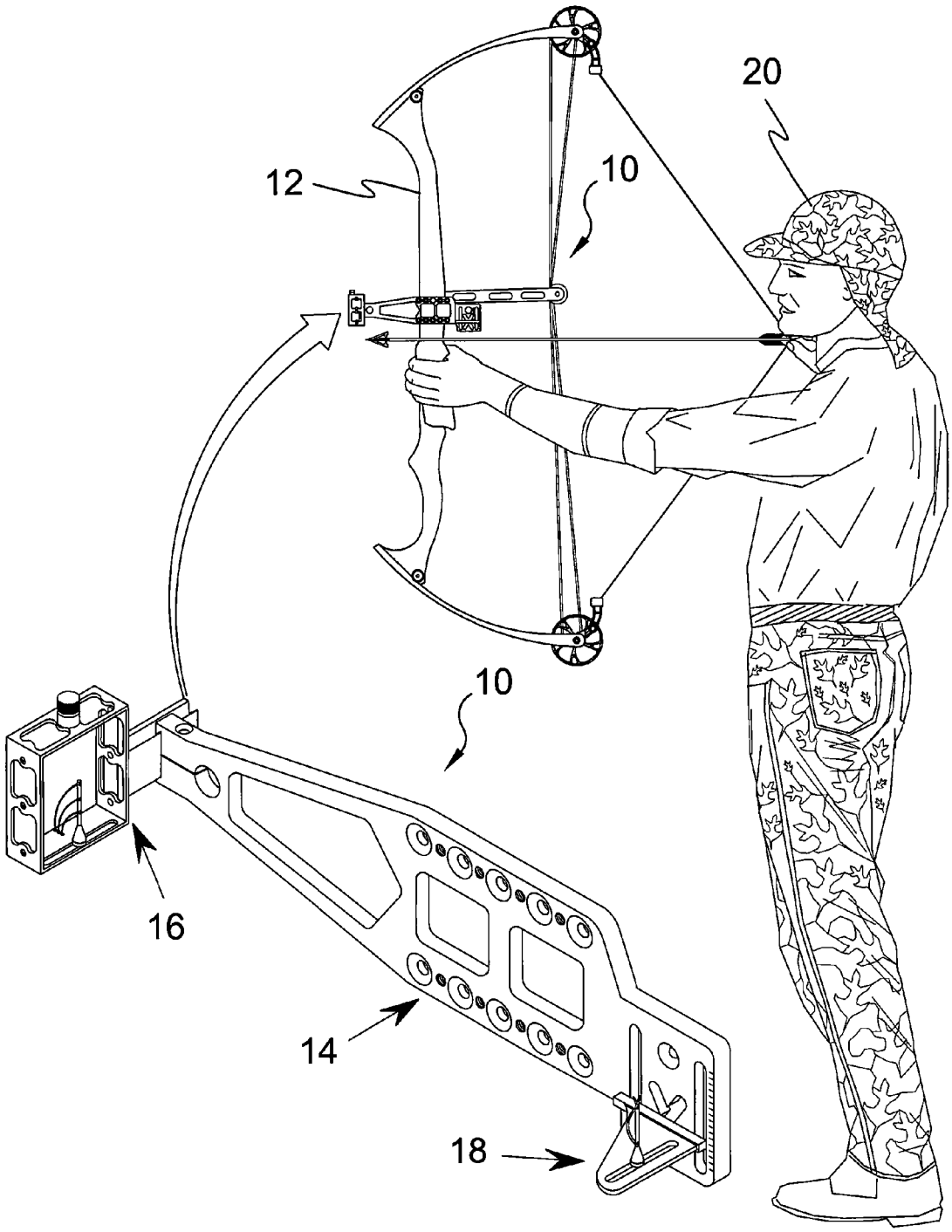
FIG. 1 is an illustrative view of the bow sighting device of the present invention in use.

Turning now descriptively to the drawings, in which similar reference characters denote similar elements throughout the several views, the figures illustrate the Bow Sighting Device of the present invention. With regard to the reference numerals used, the following numbering is used throughout the various drawing figures.

| | |
|---|---|
| 10 | Bow Sighting Device of the present invention |
| 12 | bow handle |
| 13 | bow handgrip |
| 14 | mounting bracket |
| 16 | front sight assembly |
| 18 | rear-sight assembly |
| 22 | arrow |
| 24 | line of sight |
| 26 | bow string |
| 28 | rear-sight platform |
| 30 | rear-sight pin |
| 32 | rear light switch |
| 34 | rear light |
| 36 | optical fiber |
| 37 | terminus end of 36 |
| 38 | rear-sight pin mounting slot |
| 40 | tick mark |
| 42 | mounting apertures of 14 |
| 44 | front-sight housing |
| 46 | front-sight pin |
| 48 | front-sight pin mounting slot |
| 50 | bracket mount |
| 51 | light assembly |
| 52 | front light switch |
| 54 | front light |
| 56 | front-sight mount |
| 58 | releasable track |
| 60 | lateral adjustment track of 56 |
| 62 | lateral adjustment channel of 14 |
| 64 | locking set screw |
| 66 | vertical channel |
| 68 | vertical mounting slot of 14 |
| 70 | aperture of 58 |
| 72 | threaded recess of 44 |
| 74 | fiber optic mount |
| 76 | front wall of 44 |
| 78 | side wall of 44 |
| 80 | top wall of 44 |
| 82 | bottom wall of 44 |
| 84 | battery |
| 86 | light ray |
| 88 | divergent sight pin arm |
| 90 | semi-circular sighting recess |
| 92 | elongate slot of 30 |
| 94 | dovetail |
| 96 | front end of 14 |
| 98 | rear end of 14 |
| 100 | central portion of 14 |
| 102 | alternate housing |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the bow sighting device of the present invention 10 in use. The present invention is a state of the art, light weight bow sight 10 that is capable of right or left hand mounting according to the needs of the user 20 to a bow handle 12 and provides optical fibers front and optionally rear on slidably adjustable sight-pins. A front-sight assembly 16 is connected to a mounting bracket 14 by means of lockable track and channel, which for illustrative purposes is shown as a dovetail track and dovetail channel. A rear-sight assembly 18 is connected to the mounting bracket 14 and provides a slidably adjustable rear-sight sight pin with tick marks scribed on the mounting bracket 14 for fine rear-sight platform adjustment.

Figure 2:
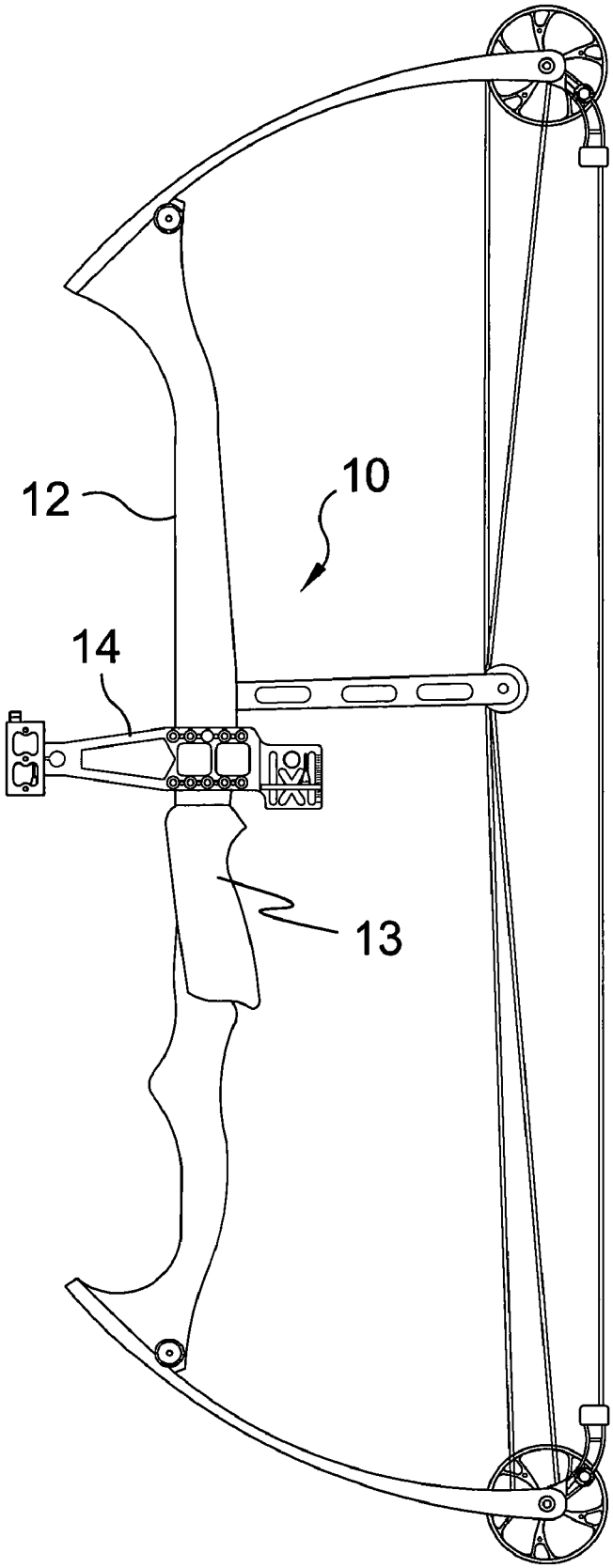
FIG. 2 is a side view of the bow sight of the present invention mounted to a compound bow.

FIG. 2 is a side view of the bow sight of the present invention 10 mounted to a compound bow handle 12 just above the hand grip 13. The light weight bow sight 10 mounting bracket 14 is capable of right or left hand mounting to a bow handle 12 and is mounted to said bow in the conventional way using bow existing sight mount apertures.

Figure 3:
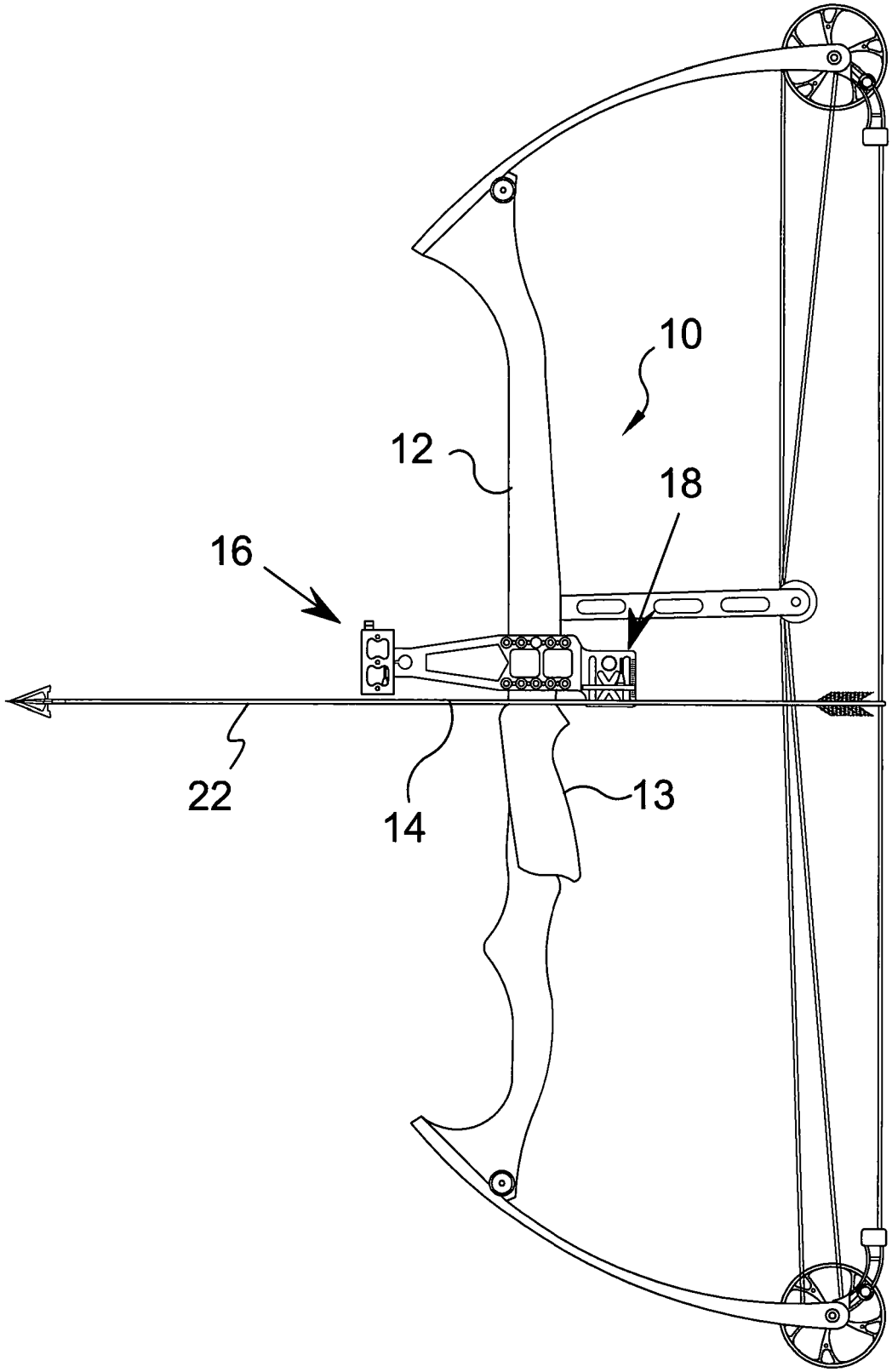
FIG. 3 is a side view of the bow sight of the present invention mounted to a compound bow.

FIG. 3 is a side view of the bow sight of the present invention 10 mounted to a compound bow 14. Shown is the mounting bracket 14 secured to the bow handle 12 above the hand grip 13 and the arrow 22 to be fired. The bow sight 10 provides optical fibers on the front and optionally rear on slidably adjustable sight-pins. A front-sight sight pin assembly 14 is connected to the mounting bracket 14 by means of track and channel. A rear-sight assembly 16 is connected to the mounting bracket and provides a slidably adjustable rear-sight sight pin with tick marks scribed on the mounting bracket for fine rear-sight adjustment. The mounting bracket 14 is made of a light weight material and provides a plurality of threaded apertures for mounting the bow sight 10 to pre existing sight mounting apertures within a bow.

Figure 4:
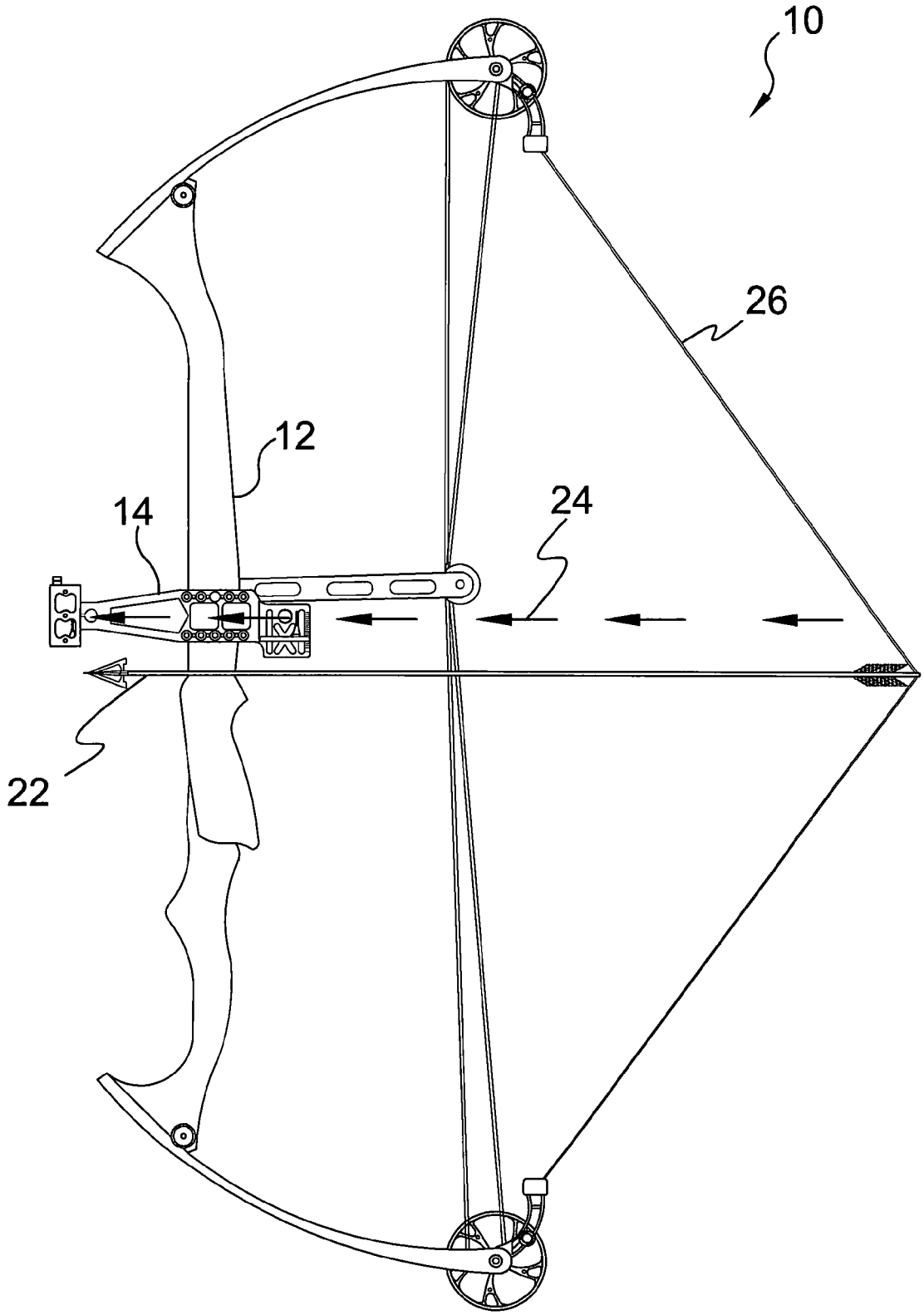
FIG. 4 is a side view of the present invention mounted to a compound bow.

FIG. 4 is a side view of the present invention 10 with the mounting bracket 14 mounted to a compound bow handle 12 illustrating a line of sight 24. The arrow 22 is drawn and the bow string 26 is taut and ready for releasing. The fiber optic front and rear pin sights are slidably adjustable with tick marks provided for fine adjustment.

Figure 5:
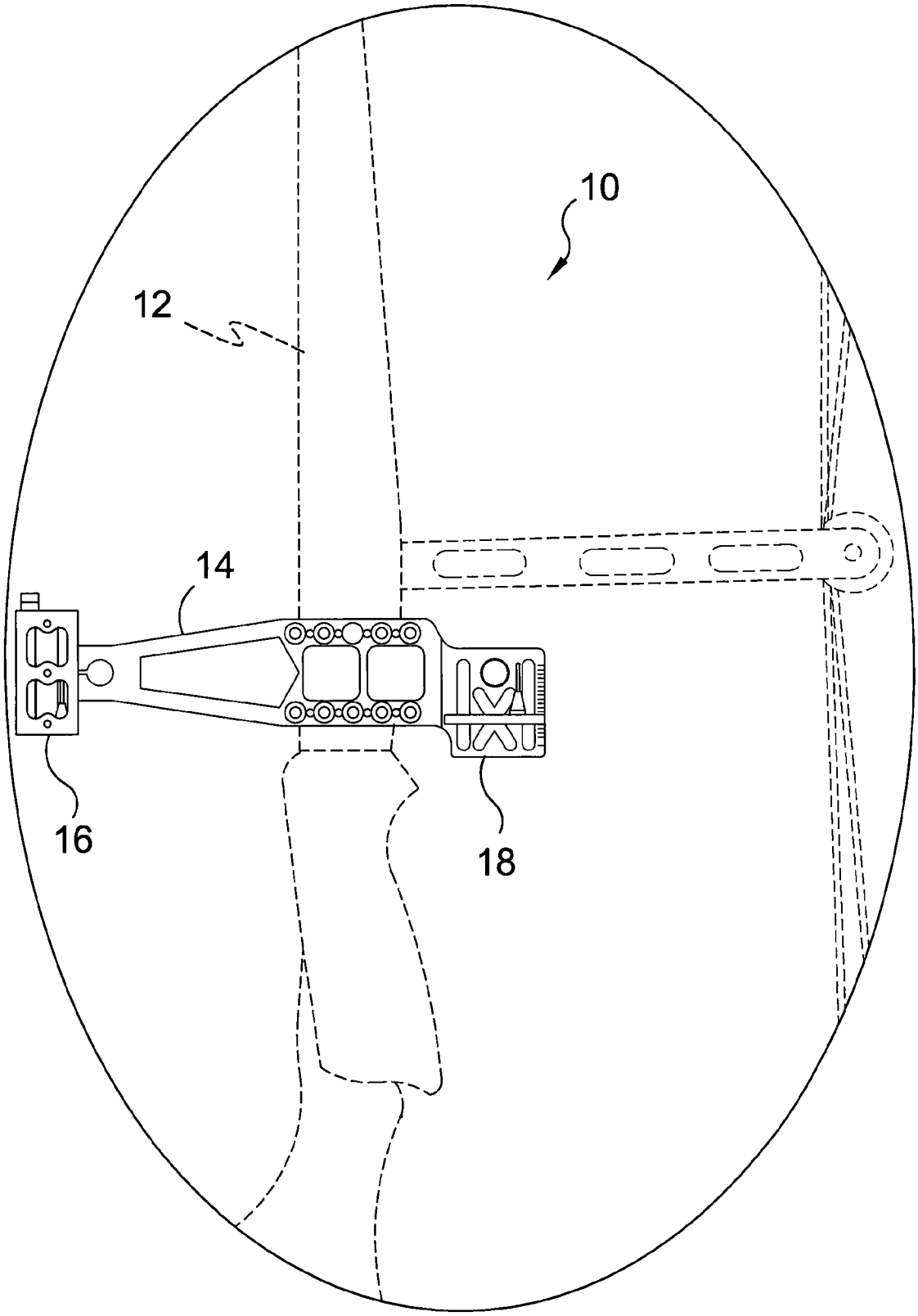
FIG. 5 is a side detailed view of the present invention mounted to a compound bow.

FIG. 5 is a side detailed view of the present invention 10 mounted to a compound bow handle 12. The front sight assembly 16 and the rear sight assembly 18 are secured and adjusted on the mounting bracket 14

Figure 6:
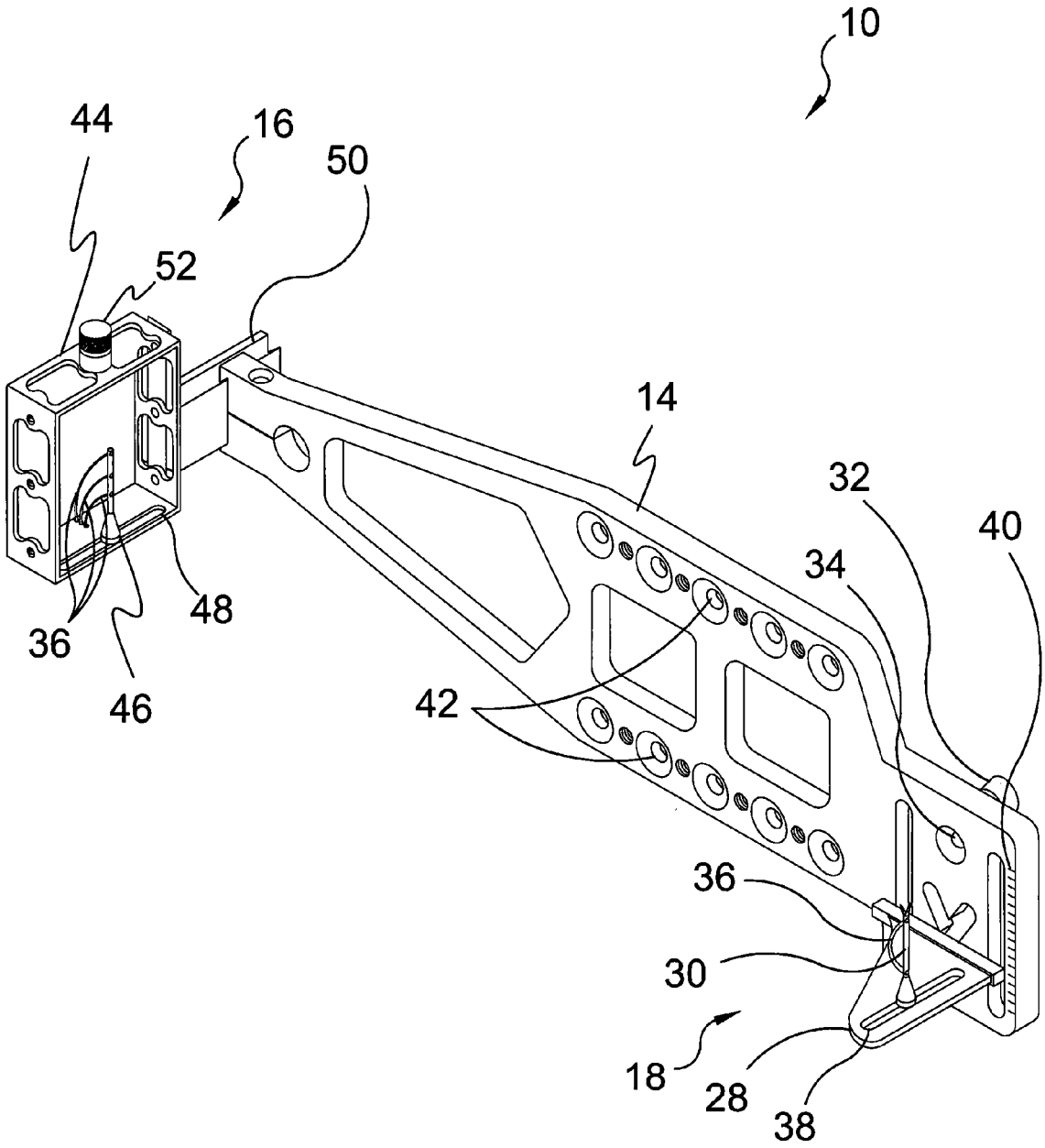
FIG. 6 is a perspective view of the bow sighting device of the present invention.

FIG. 6 is a perspective view of the bow sighting device of the present invention 10 having front 16 and rear 18 sighting assemblies releasably attached to the mounting bracket 14 whereby targeting adjustments can be made in addition to mounting adjustments for left or right handed users and is mounted to the bow handle by a plurality of mounting apertures 42. The present invention 10 optionally provides for a switch 32 engageable lighting element 34 positioned approximate the rear-sight sight-pin 30 when using a sight-pin 30 that incorporates optical fiber 36. The rear sight assembly 18 further comprises a platform 28 that is vertically adjustable on the mounting bracket 14 which further includes a plurality of tic marks 40 to enable precision adjustment thereof. A rear sight pin 30 mounting slot 58 allows for lateral adjustment of the sight pin 30. The front-sight assembly 16 comprises a sight-pin housing 44, a front sight bracket mount 50, a front sight pin 46 mounting slot 48, a front sight light switch 52, a front sight light and at least one optical fiber 36. Alternately provided for is a rear-sight sight-pin having a longitudinal slot within the body instead of the optical fiber.

Figure 7:
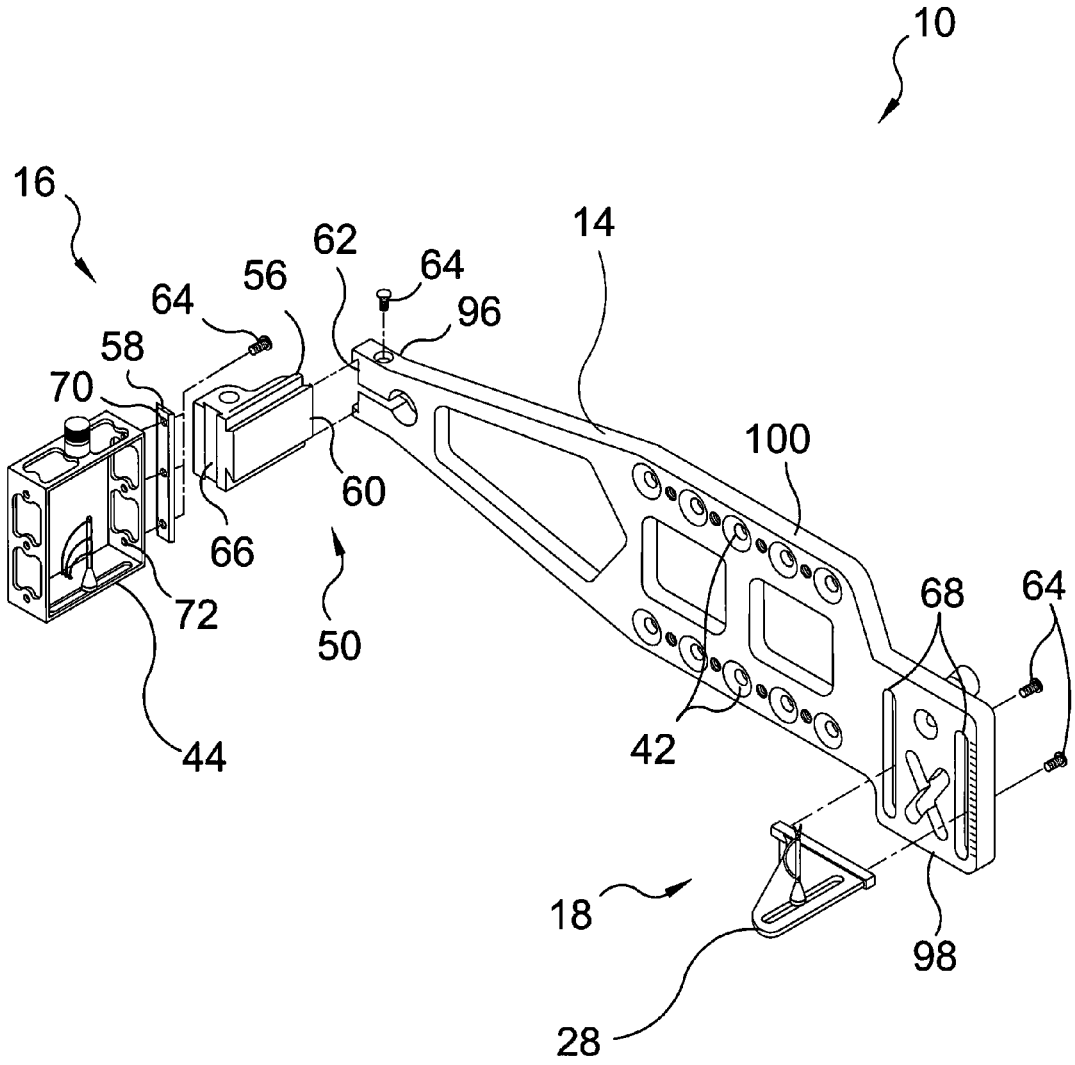
FIG. 7 is an exploded perspective view of the present invention.

FIG. 7 is an exploded perspective view of the present invention 10. The front-sight bracket mount 50 is an assembly used to secure the front-sight assembly 16 to the front 96 mounting bracket 14 for either right handed or left handed use. The bracket mount 50 comprises a front-sight mount 56 and a releasable track 58. The front-sight mount 56 has a lateral adjustment track 60 that is slidably secured within a lateral adjustment channel 62 disposed in the front end 96 of the mounting bracket 14. Once the front-sight mount 56 is installed in position for the selected right or left handed use, the releasable track 58 has a plurality of apertures 70 and is screwed 64 onto the threaded recesses 72 on the appropriate side of the housing 44 and slid into a mating releasable track channel 66 on the front-sight mount 56. Preferably the lateral adjustment track 60 and channel 62 have a dovetail configuration. The platform 28 of the rear-sight assembly 18 is mounted and vertically adjusted to the rear end 98 of the mounting bracket 14 with locking screws 64 extending through vertical mounting slots 68 disposed therein. Mounting bracket apertures 42 are disposed on the central portion 100 of the mounting bracket 14 for attachment to the bow handle.

Figure 8:
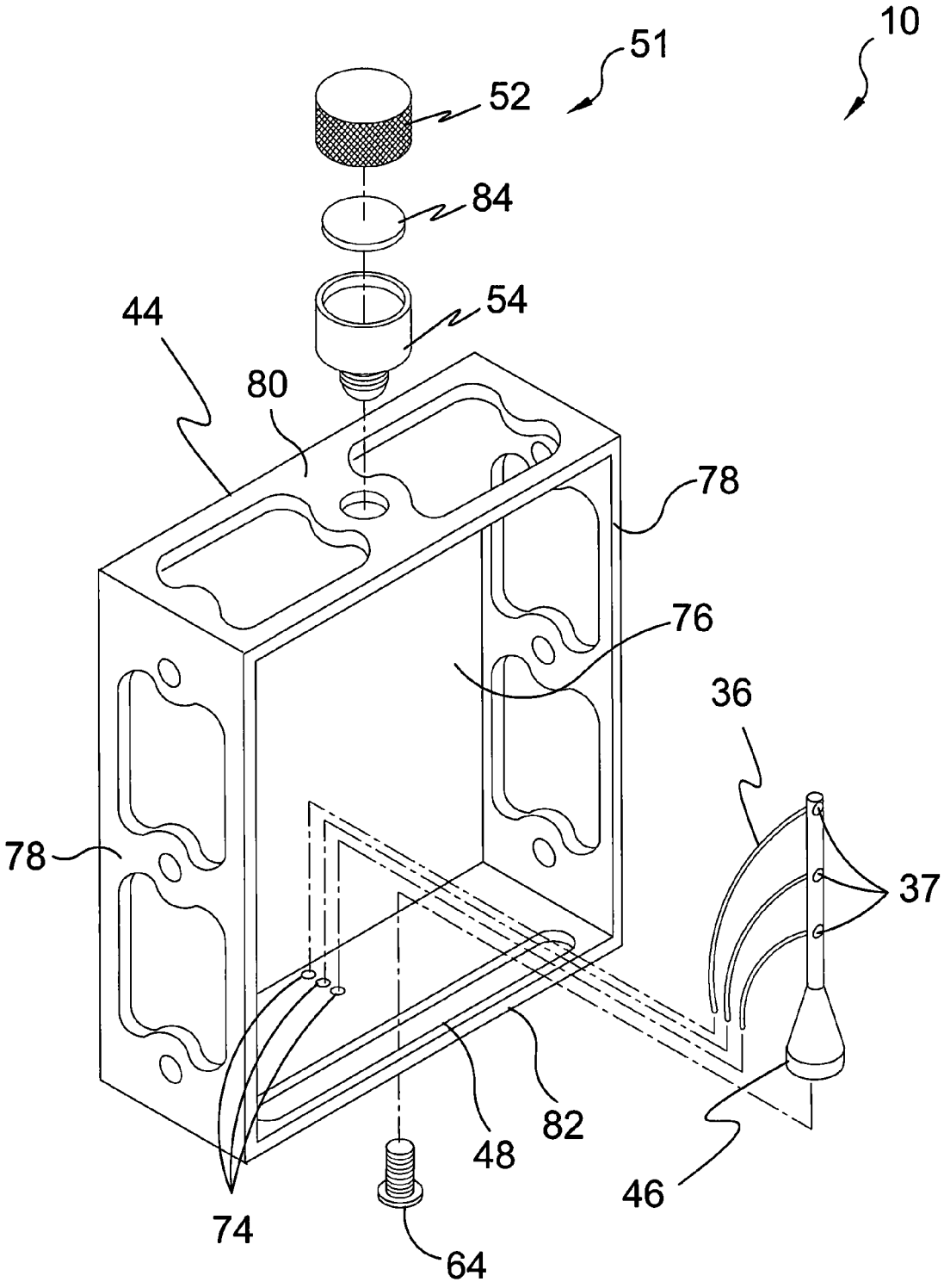
FIG. 8 is an exploded view of the front-sight housing of the present invention.

FIG. 8 is an exploded view of the front-sight housing 44 of the present invention 10. The housing 44 has a front wall 76 with side walls 78, a top wall 80 and a bottom wall 82 depending from the respective edges thereof. The front-sight pin 46 is slidably mounted therein and secured in position with a locking screw 64 passing through the mounting slot 58. A plurality of optical fibers 36 extend from fiber optic mounts 74 through the front-sight pin 46 with the terminus ends 37 oriented towards the rear-sight assembly. A lighting assembly 51 is provided to illuminate the optical fibers 36. The lighting assembly 51 comprises the light switch 52, a battery 84 and the light 54 to impinge light rays to the optical fibers 36.

Figure 9:
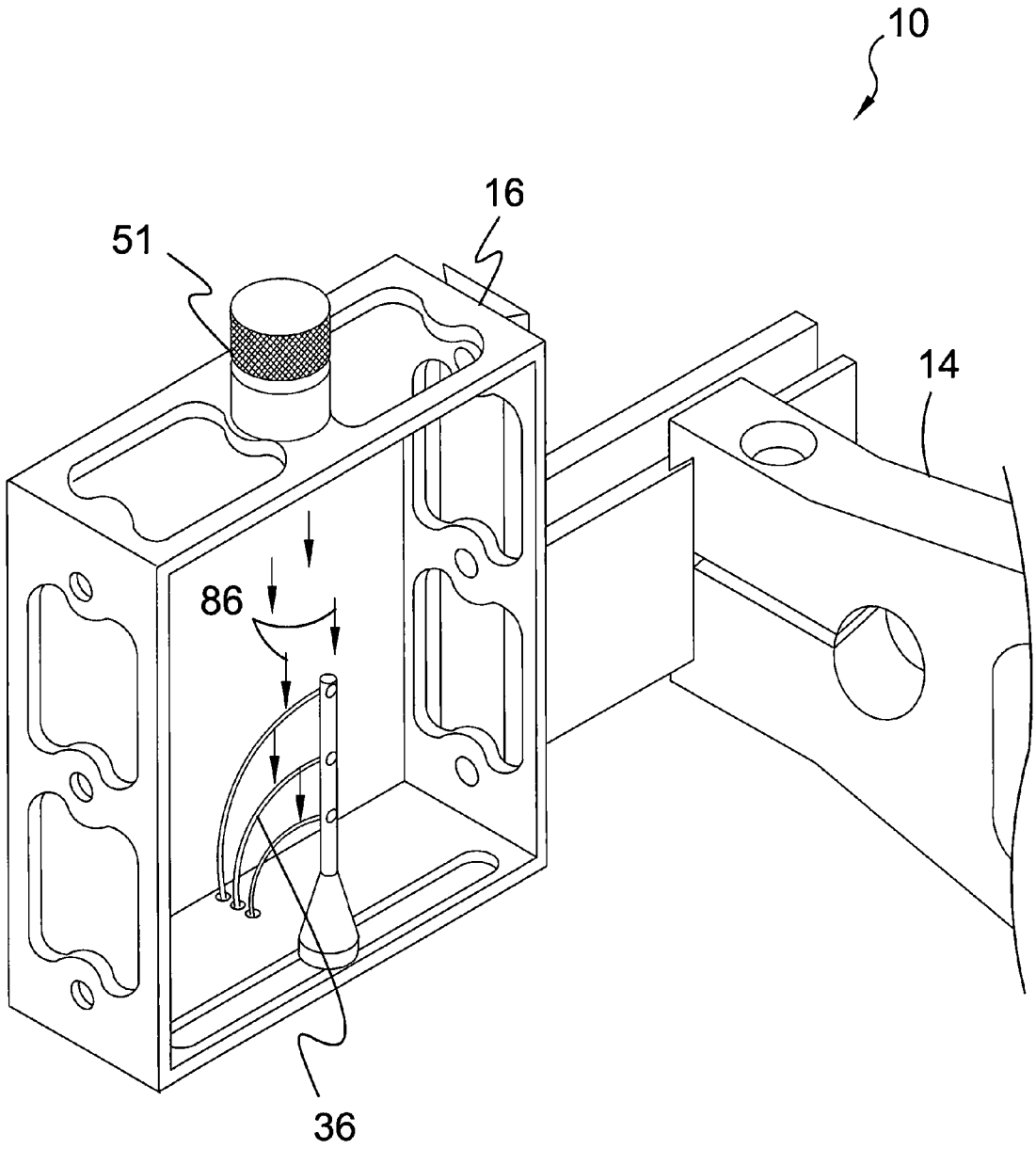
FIG. 9 is an enlarged view of the front-sight mounted to the mounting bracket.

FIG. 9 is an enlarged view of the front-sight assembly 16 of the present invention 10 mounted to the mounting bracket 14. Shown are light rays 86 emanating from the light assembly 51 to illuminate the optical fibers 36.

Figure 10:
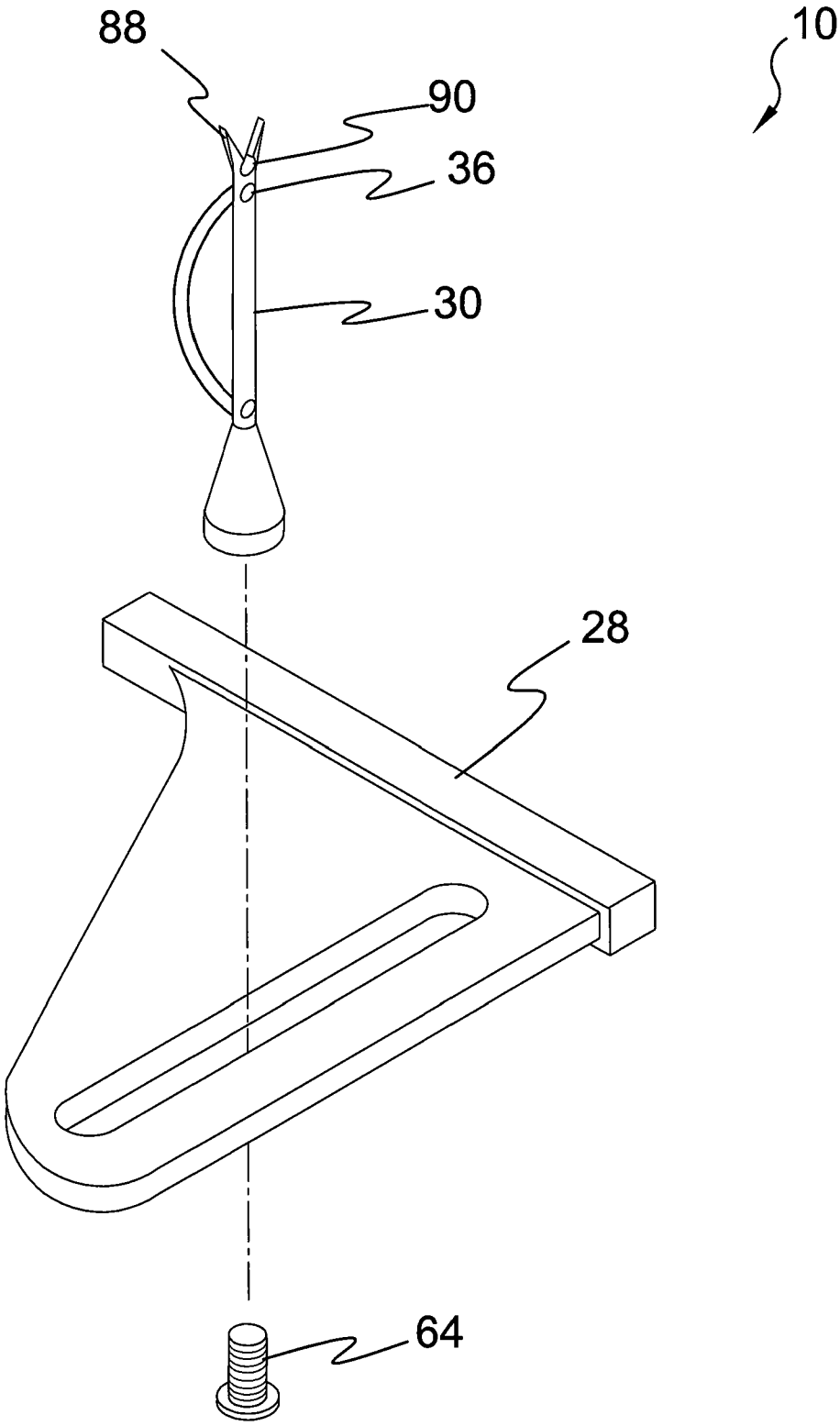
FIG. 10 is an enlarged view of the rear-sight platform of the present invention.

FIG. 10 is an enlarged view of the rear-sight platform 28 of the present invention 10. A rear-sight platform 28 is connected to the mounting bracket and provides mounting thereto of a sight-pin 30 that may have an optical fiber 36 positioned therein. The sight pin 30 has a substantially y-shape apex formed by divergent arms 88 extending from a semicircular sighting recess 90, which by design provides for easily aligning the semicircular sighting recess 90 with the desired pin point of optical fiber positioned within the front-sight sight-pin. The rear-sight pin 30 is laterally positioned and secured to the platform 28 with a set screw 64 extending through the mounting slot 38.

Figure 11:
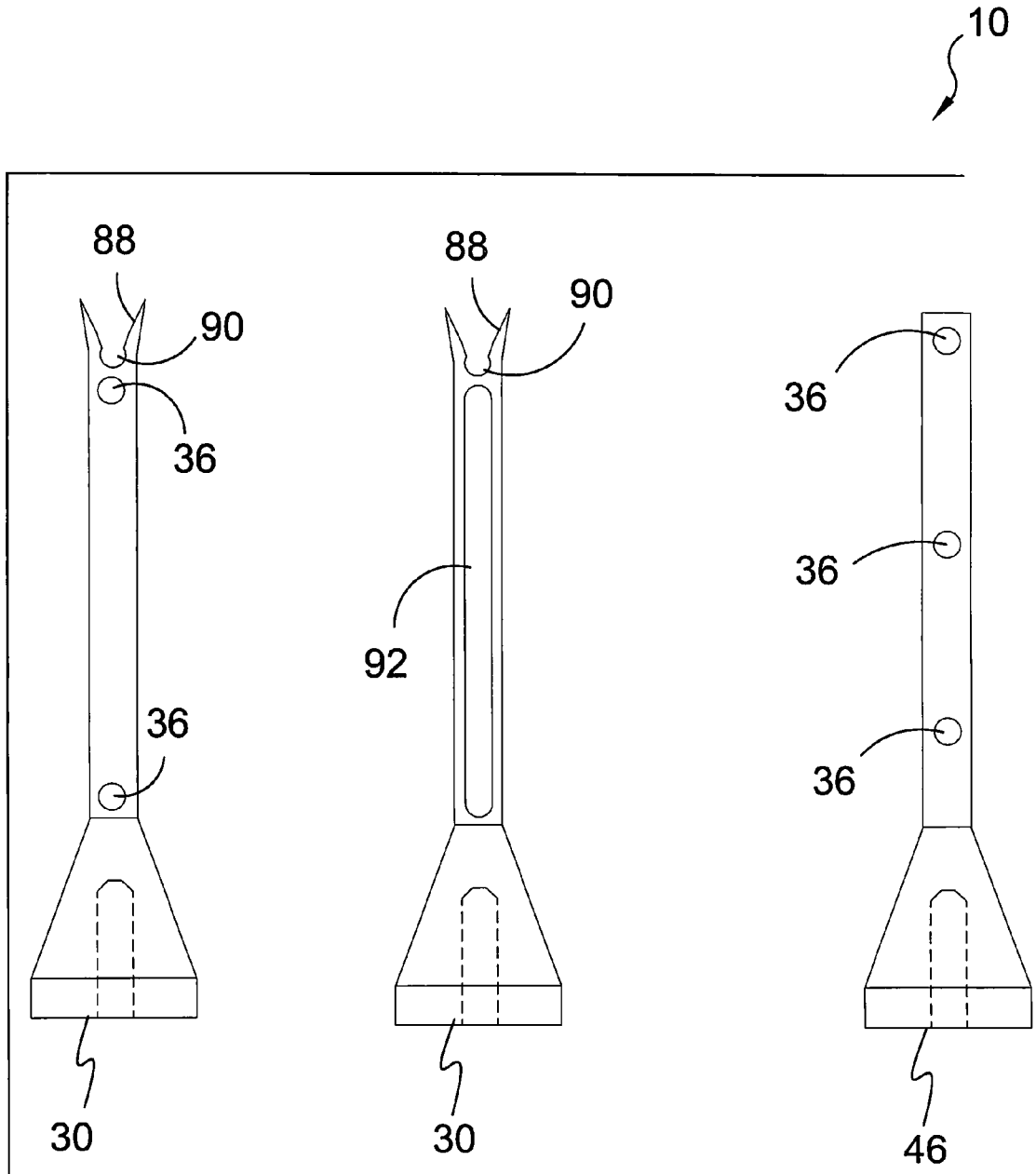
FIG. 11 are various sight-pins of the present invention.

FIG. 11 are various sight-pins of the present invention 10. All of the sight pins have a substantially y-shape apex formed by divergent arms 88 extending from a semicircular sighting recess 90, which by design provides for easily aligning the semicircular sighting recess 90 with the desired pin point of optical fiber 36 positioned within the front-sight pin 46. More than one optical fiber 36 may be positioned within the front sight pin 46 and may be of different colors. Furthermore, the instant invention provides that the one or more optical fibers 36 may extend from the back side of the front-sight pin 46 and be anchored in such a manner as to be hidden from view when using the sighting device. A switch-engageable lighting element (not shown) will illuminate the optical fibers 36 providing pin points of light emanating from the optical fiber ends terminating in the front side of the pin. The rear sight pin 30 may also have one or more optical fibers 36 having terminal ends on the front side of the pin which can be illuminated from a selectively engageable lighting element (not shown). Optionally provided for is a rear site pin 30 having an elongated slot 92 in the body in lieu of the optical fibers 36, various other optical fiber enable sight-pins are provided and interchangeable comprising, a 3 dot, and 4 dot having ¼ inch gaps between the optical fibers with a 5 dot having a ⅛ inch gap between the optical fibers 36.

Figure 12:
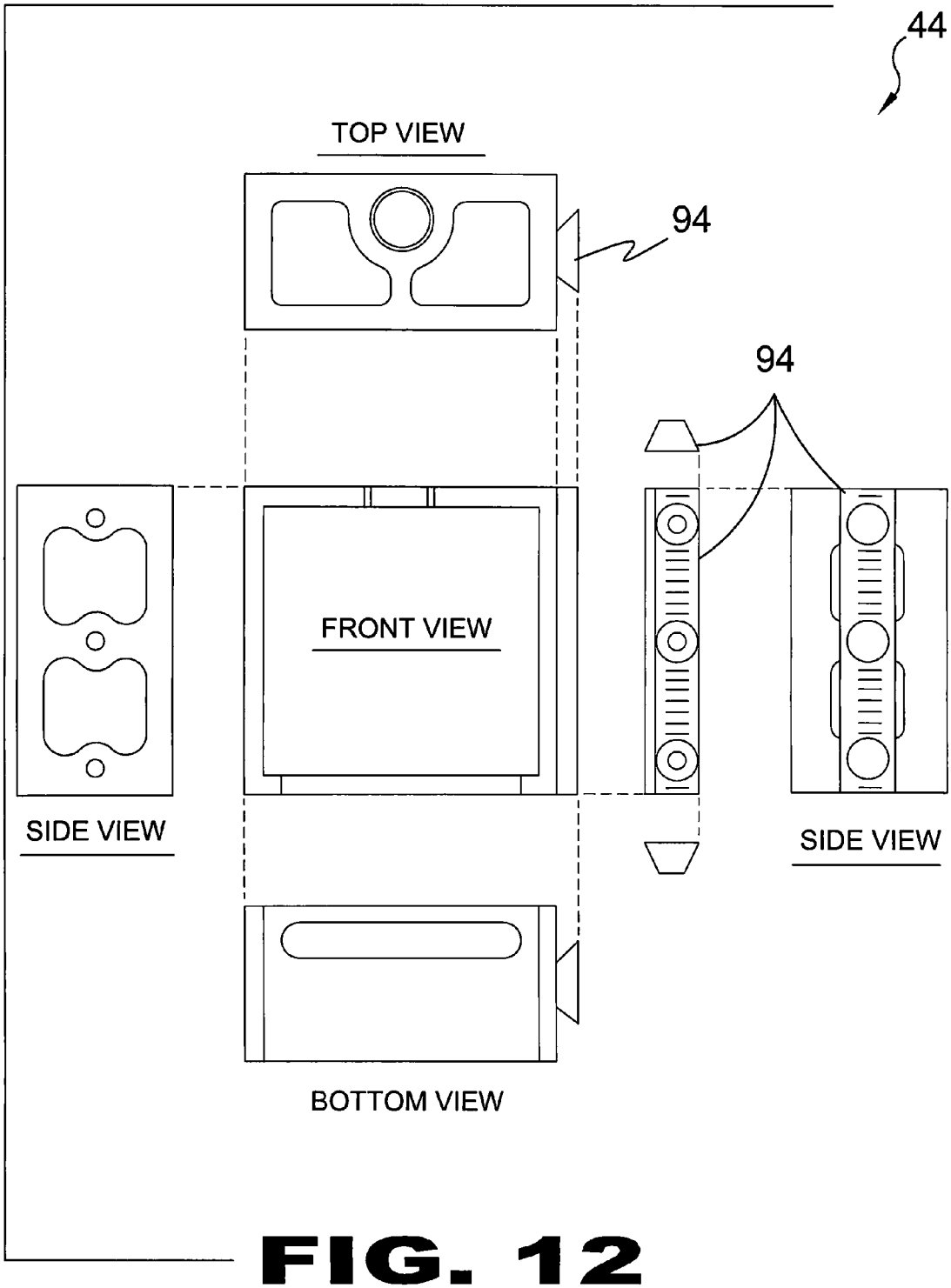
FIG. 12 are various plan views of the front-sight sight-pin housing of the present invention.

FIG. 12 are various plan views of the front-sight sight-pin housing 44 of the present invention. Shown are various views of the front-sight sight-pin housing 44 having a releasable track, preferably dovetail 94 shaped, which is mountable to one side of the housing or the other depending on whether the user is right or left handed.

Figure 13:
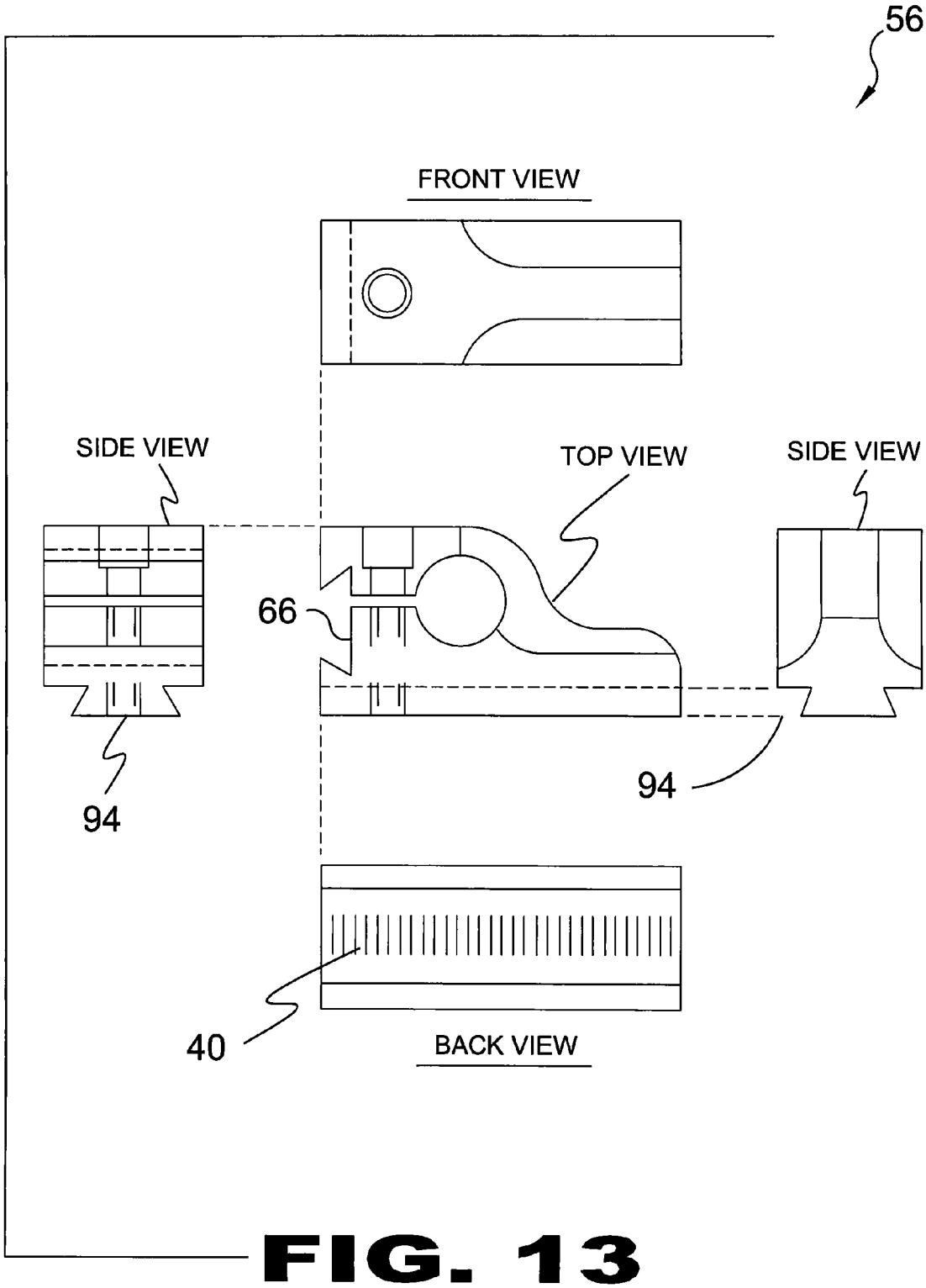
FIG. 13 are various plan views of the front-sight mounting of the present invention.

FIG. 13 are various plan views of the front-sight mounting 56. Shown is the front-sight mounting having a releasable track channel 66 on one end matingly engageable to the releasable track that is fastened to one side or the other of the front-sight sight-pin housing depending on whether the sighting device is being used by a left-handed or right-handed user. Also shown, is the front-sight mounting having a dove-tail track 94 matingly engageable to the mounting bracket and tic marks 40 for precision adjustments.

Figure 14:
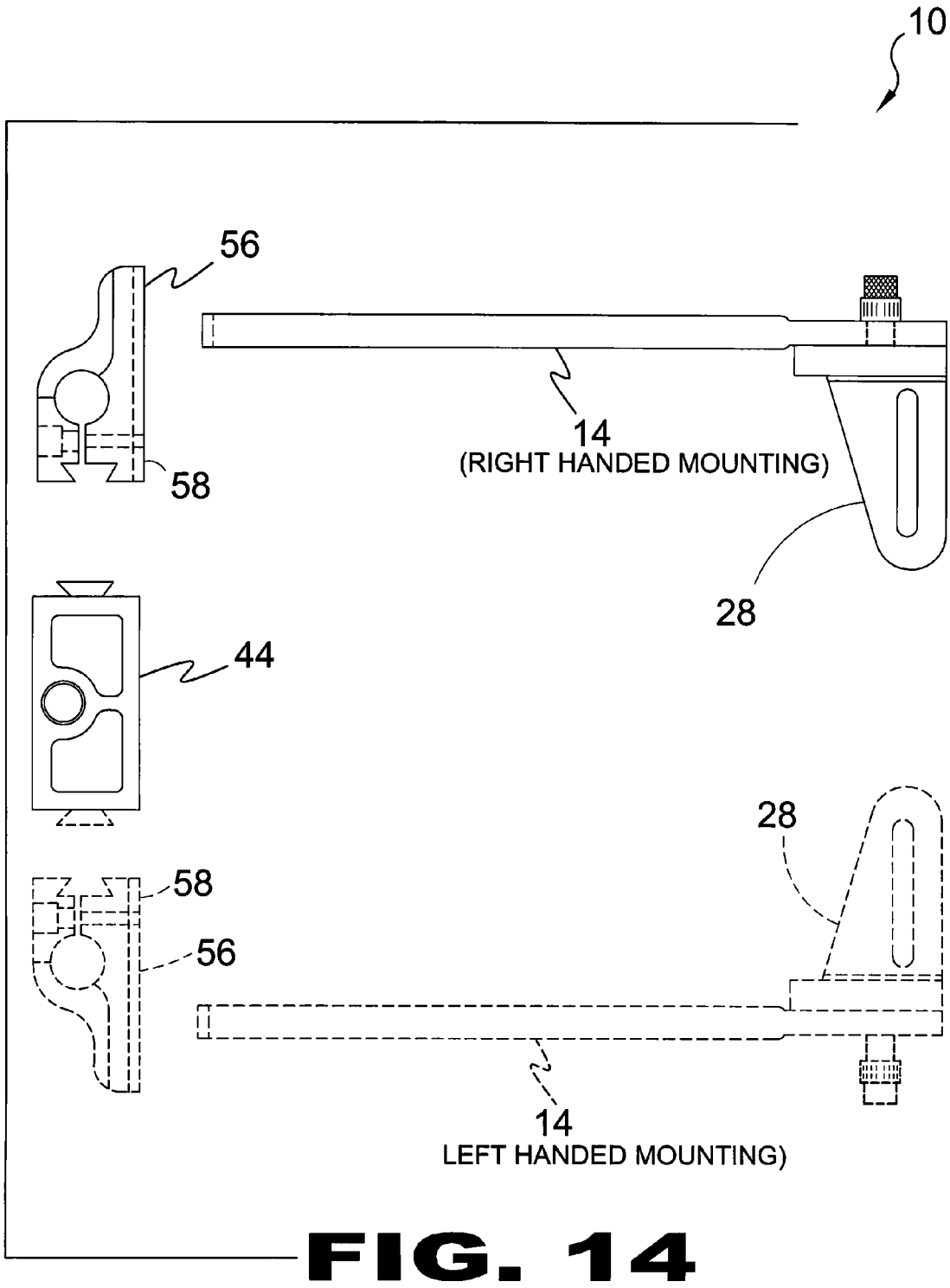
FIG. 14 is an exploded view of the bow sighting device of the present invention.

FIG. 14 is an exploded view of the bow sighting device of the present invention 10. Shown is the bow sight of the present invention comprising a front-sight sight-pin housing 44 having a releasable track 58 fastened to one side of the housing 44 for right-handed users and releasably fastened to the other side for left-handed users. The rear-sight platform 28 is also shown in its relative position for right-handed users and moved to the opposing side of the mounting bracket 14 for left-handed users along with the optical fiber lighting element when using a rear-sight sight-pin incorporating an optical fiber as opposed to the slotted rear-sight sight-pin previously shown.

Figure 15:
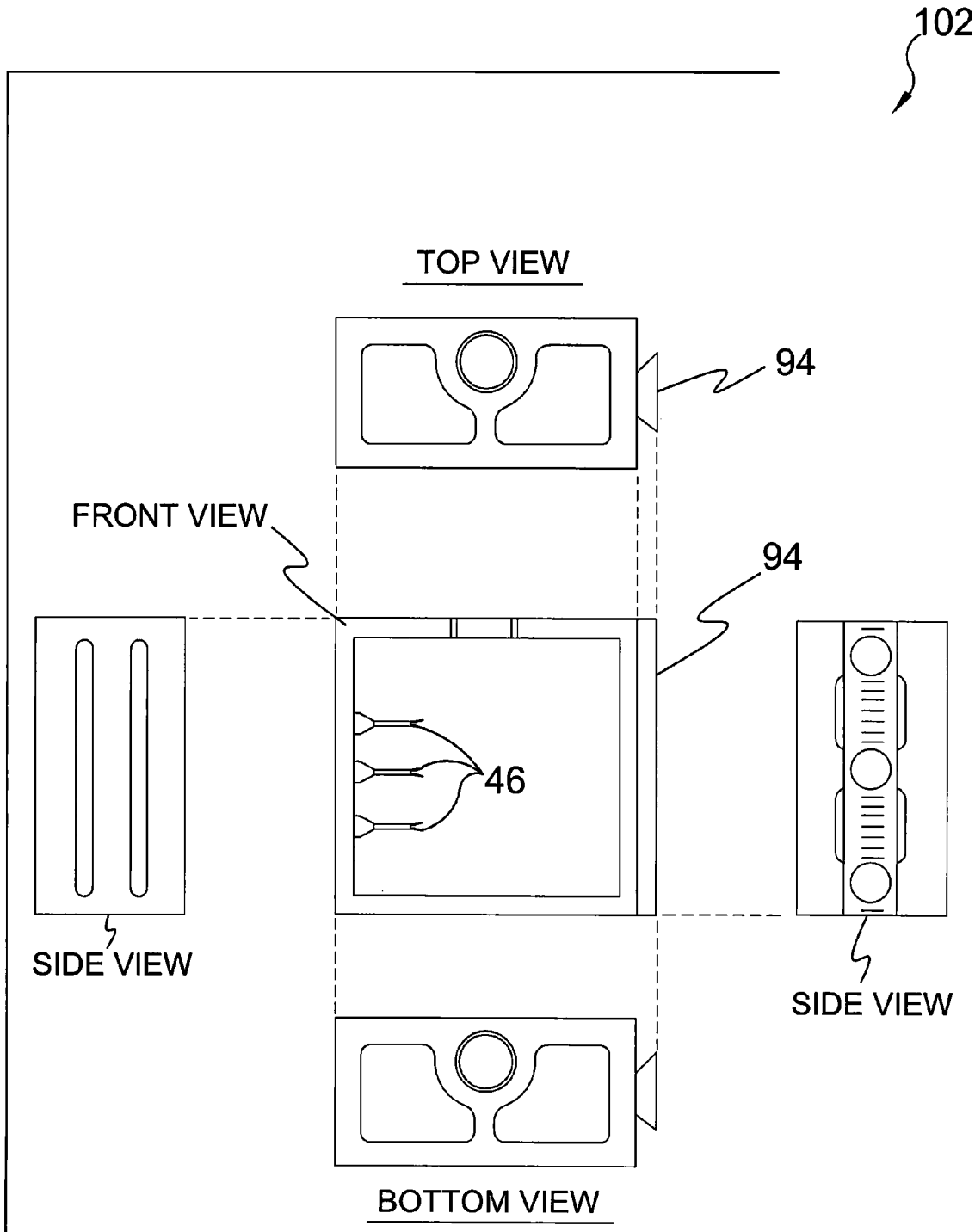
FIG. 15 are various plan views of an alternate front-sight sight-pin housing of the present invention.

FIG. 15 are various plan views of an alternate front-sight sight-pin housing 102 of the present invention. Shown are various views of the alternate front-sight sight-pin housing having a releasable track, preferably dovetail 94 shaped, which is mountable to one side of the housing or the other depending on whether the user is right or left handed. As illustrated a plurality of spaced apart sight-pins 46 are mounted to the side of the sight-pin housing 102.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bow sighting device having an improved configuration of sight pins and for accurate targeting in low-light comprising:

a) a mounting bracket for attaching said device to the handle of a bow;

b) a front-sight assembly with a front-sight pin engaged with the front end of said mounting bracket in a fashion allowing for the slidable adjustment vertically and laterally thereof;

c) a rear-sight assembly with a rear-sight pin wherein the apex has a pair of continuously divergent sight arms with a semi-circular recess disposed at the point of convergence used for alignment with said front-sight pin for accurate targeting; and d) fiber optic lighting associated with at least one sight pin.

2. A bow sighting device having an improved configuration of sight pins and for accurate targeting in low-light comprising:

a) a mounting bracket for attaching said device to the handle of a bow;

b) a front-sight assembly with a front-sight pin engaged with the front end of said mounting bracket in a fashion allowing for the slidable adjustment vertically and laterally thereof;

c) a rear-sight assembly with a rear-sight pin wherein the apex has a pair of divergent sight arms with a semi-circular recess disposed at the point of convergence used for alignment with said front-sight pin for accurate targeting;

d) fiber optic lighting associated with at least one sight pin;

e) wherein said front-sight assembly comprises:

i) a housing for said front-sight pin having a front wall with a top wall, a bottom wall and two side walls depending therefrom;

ii) a plurality of corresponding threaded apertures disposed in said housing sidewalls;

iii) a releasable track having a plurality of apertures corresponding with said threaded apertures for receiving screws for attachment to the appropriate said sidewall as determined by the required left or right handed usage thereof; and iv) a front-sight mount having a track that is slidably engaged with a mating channel disposed at the front end of said mounting bracket and can be moved laterally therein;

f) wherein said bottom wall of said housing further comprises a longitudinally disposed slot through which a set screw is passed to secure said front-sight pin in a selected side-to-side position therein;

g) wherein a plurality of spaced apart optical fibers are mounted on one end to said housing and on the other through said front-sight pin oriented toward said rear-sight assembly thereby presenting a plurality of pin-points of light to the view of the archer; and h) wherein said rear-sight assembly comprises:

i) a plate extending horizontally from said mounting bracket forming a rear-sight platform;

ii) a slot in said platform extending in perpendicular relation relative to said mounting bracket for securing said rear-sight pin and providing side to side adjustment thereof; and iii) a pair of parallel vertical slots disposed in the rear portion of said mounting bracket to permit passage of a set screw therethrough to vertically position and secure said platform.

3. The bow sighting device recited in claim 2, wherein said front-sight assembly and rear-sight assembly are accordingly installed on said mounting bracket for use by right or left handed usage.

4. The bow sighting device recited in claim 2, wherein said front-sight pin includes a plurality of spaced apart optical fibers.

5. The bow sighting device recited in claim 4, further including a light assembly to impinge light to said optical fibers and provide illumination thereto.

6. The bow sighting device recited in claim 5, wherein said light assembly comprises:

a) a light;

b) a battery to provide power to said light; and c) a light switch to selectively provide power to said light to illuminate said optical fibers.

7. The bow sighting device recited in claim 2, wherein front-sight mount track and said mating channel in said mounting bracket have a dovetail configuration.

8. The bow sighting device recited in claim 2, wherein the central portion of said mounting bracket further includes a plurality of apertures for mounting said bow sighting device to pre existing sight mounting apertures within a bow handle.

9. The bow sighting device recited in claim 2, wherein at least one optical fiber is mounted on one end to said platform and on the other end through said rear-sight pin oriented toward the archer thereby presenting a pinpoint of light to the view thereof.

10. The bow sighting device recited in claim 9, further including a light assembly to impinge light to said optical fibers and provide illumination thereto.

11. The bow sighting device recited in claim 10, wherein said light assembly comprises:

a) a light;

b) a battery to provide power to said light; and c) a light switch to selectively provide power to said light to illuminate said optical fibers.

12. A bow sighting device having an improved configuration of sight pins and for accurate targeting in low-light comprising:

a) a mounting bracket for attaching said device to the handle of a bow;

b) a front-sight assembly with a front-sight pin engaged with the front end of said mounting bracket in a fashion allowing for the slidable adjustment vertically and laterally thereof;

c) a rear-sight assembly with a rear-sight pin wherein the apex has a pair of divergent sight arms with a semi-circular recess disposed at the point of convergence used for alignment with said front-sight pin for accurate targeting;

fiber optic lighting associated with at least one sight pin:

d) wherein said rear-sight assembly comprises:

i) a plate forming a rear-sight platform;

ii) a slot in said platform extending in perpendicular relation relative to said mounting bracket for securing said rear-sight pin; and iii) a pair of parallel vertical slots disposed in the rear portion of said mounting bracket to permit passage of a set screw therethrough to horizontally position and secure said platform; and h) wherein said rear-sight pin has a longitudinally extending slot positioned to enable the archer to peer therethrough to easier align said rear-sight pin with said front-sight pin.

* * * * *